US012415644B2

(12) United States Patent
McElfresh

(10) Patent No.: US 12,415,644 B2
(45) **Date of Patent: *Sep. 16, 2025**

(54) BOTTLE HAVING REMOVABLE BASE

(71) Applicant: CREW Bottle LLC, Los Angeles, CA (US)

(72) Inventor: Kyle Logan McElfresh, Los Angeles, CA (US)

(73) Assignee: CREW Bottle LLC, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/619,635

(22) Filed: Mar. 28, 2024

(65) Prior Publication Data

US 2024/0239546 A1 Jul. 18, 2024

Related U.S. Application Data

(63) Continuation of application No. 17/127,381, filed on Dec. 18, 2020, now Pat. No. 11,970,306, which is a continuation-in-part of application No. 16/016,073, filed on Jun. 22, 2018, now abandoned.

(51) Int. Cl.
*B65D 1/06* (2006.01)
*B65D 41/04* (2006.01)

(52) U.S. Cl.
CPC ..... *B65D 1/06* (2013.01); *B65D 41/0407* (2013.01); *B65D 41/0442* (2013.01)

(58) Field of Classification Search
CPC .. B65D 1/06; B65D 41/0407; B65D 41/0442; B65D 41/0435; B65D 41/0457
USPC ..... 215/377; 220/625
See application file for complete search history.

(56) References Cited

U.S. PATENT DOCUMENTS

| | | | | |
|---|---|---|---|---|
| 640,860 | A | 1/1900 | Baum, Jr. | |
| 2,086,404 | A | 7/1937 | Daniels | |
| 2,753,068 | A | 7/1956 | Robinson | |
| 3,019,950 | A | 2/1962 | Callegari | |
| 3,124,264 | A * | 3/1964 | Waisberg | B65D 1/06 215/205 |
| 3,438,530 | A | 4/1969 | Wallace | |
| 4,762,241 | A | 8/1988 | Lang | |
| 5,131,553 | A | 7/1992 | Geasland | |
| 5,141,136 | A | 8/1992 | Tignor | |
| 5,344,036 | A | 9/1994 | Stanescu | |

(Continued)

FOREIGN PATENT DOCUMENTS

| | | | |
|---|---|---|---|
| DE | 200288 | C | 7/1908 |
| WO | 9937190 | A1 | 7/1999 |
| WO | 2017216187 | A1 | 12/2017 |

OTHER PUBLICATIONS

International Search Report and Written Opinion for international Application No. PCT/US19/37893 dated Sep. 19, 2019, 10 pages.

(Continued)

*Primary Examiner* — Anthony D Stashick
*Assistant Examiner* — Raven Collins
(74) *Attorney, Agent, or Firm* — Miller Johnson

(57) ABSTRACT

The present application relates to a bottle comprising a reservoir, a first opening on a first end of the bottle providing access to the reservoir, a second opening on a second end of the bottle providing access to the reservoir; and a removable base covering the second opening.

14 Claims, 18 Drawing Sheets

(56) References Cited

U.S. PATENT DOCUMENTS

| | | | | |
|---|---|---|---|---|
| 5,829,607 | A | 11/1998 | Ibrahim | |
| 6,164,473 | A | 12/2000 | Waldrip | |
| 6,398,050 | B1 | 6/2002 | Allora | |
| 6,719,159 | B2 | 4/2004 | Chomik | |
| 6,905,038 | B2 | 6/2005 | Lopez | |
| D642,060 | S | 7/2011 | Leclair | |
| 8,763,849 | B2 | 7/2014 | Benetti | |
| D760,601 | S | 7/2016 | Bochner | |
| 9,504,341 | B2 | 11/2016 | Suprina | |
| 9,950,827 | B1 * | 4/2018 | Lau | B65D 51/1644 |
| 2002/0074367 | A1 | 6/2002 | Kawakita | |
| 2004/0118804 | A1 | 6/2004 | Westerhold | |
| 2005/0092760 | A1 | 5/2005 | Westerhold | |
| 2007/0284332 | A1 | 12/2007 | Gowans | |
| 2009/0001043 | A1 * | 1/2009 | Benetti | B65D 1/06 215/377 |
| 2009/0050598 | A1 * | 2/2009 | Huang | B65D 23/001 220/636 |
| 2013/0228544 | A1 | 9/2013 | Benetti | |
| 2014/0190972 | A1 | 7/2014 | Gowans | |
| 2015/0093477 | A1 | 4/2015 | McNamara | |
| 2018/0305091 | A1 | 10/2018 | Krafft | |

OTHER PUBLICATIONS

"The Alkemista Alcohol Infusion Vessel, https://www.kickstarter.com/projects/ethanashe/the-alkemista-alcohol-infusion-vessel#prototype-slide-10390, Last updated: Aug. 8, 2017 ".

Ethan + Ashe Alkemista Infusion Vessel 950ml in Stainless Steel, https://www.amazon.com/Ethan-Ashe-Alkemista-Infusion-Vessel/dp/B077CSS2LJ?th=1, Date first available: Nov. 12, 2017.

* cited by examiner

BOTTLE HAVING REMOVABLE BASE

CROSS REFERENCE TO RELATED APPLICATIONS

This application is a continuation of U.S. application Ser. No. 17/127,381 filed Dec. 18, 2020 and titled "BOTTLE HAVING REMOVABLE BASE", which is a continuation in part of U.S. application Ser. No. 16/016,073 filed Jun. 22, 2018 and titled "BOTTLE HAVING REMOVABLE BASE." U.S. application Ser. No. 16/016,073 and Ser. No. 17/127,381 are hereby fully incorporated by reference as if set forth fully herein.

FIELD

The present invention relates generally to liquid bottles. More particularly, the present invention relates to a liquid bottle having a removable base.

BACKGROUND

Conventional bottles generally have a narrow opening at a top end for pouring liquid into and out of the bottle. Conventional bottles are common within the bar and restaurant industry and frequently used by bartenders to serve drinks.

The narrow opening on the top of the conventional bottle generally has a smaller diameter than a diameter of a reservoir of the bottle so that the liquid can be poured precisely and reliably. However, if the conventional bottle were to be reused, the narrow opening makes it difficult for a user to insert more liquid into the bottle and to clean the inside of the bottle. Specifically, it is extremely difficult to clean build-up near shoulders of the bottle where the bottle widens from a bottleneck.

Some known solutions to these problems employ a removable base. However, these know solutions suffer from additional problems such as condensation or other liquid becoming trapped in a gab between the removable base and the rest of the bottle.

In view of the above, there is a continuing, ongoing need for improved bottles and reservoirs.

DETAILED DESCRIPTION

Figure 1A:
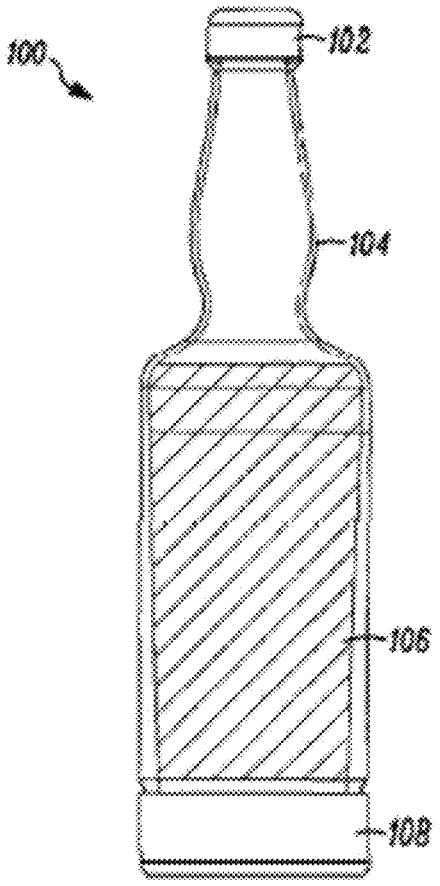
FIGS. 1A-1G are views of a bottle in accordance with a first embodiment.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include a bottle having two openings: a first opening on a top end of the bottle and a second opening on a bottom end of the bottle. According to an exemplary embodiment, the first opening can be an opening at an end of a bottleneck of the bottle, and the first opening can have a substantially smaller diameter than a diameter of the second opening. Furthermore, according to an exemplary embodiment, the second opening can be at another end of the bottle opposite the bottleneck. In order to store liquid in the bottle without spilling, the bottle can include a removable cap covering the first opening and a removable base covering the second opening. In some embodiments, the removable cap can also comprise a cork, a universally-sized pour spout, or a lid.

In some embodiments, the removable base can have a circumference substantially equal to the circumference of the bottle. In some embodiments, the circumference of the removable base can be smaller or larger than the circumference of the bottle, but according to a preferred embodiment, the circumference of the removable base is substantially equal to the circumference of the bottle to generate a flush appearance between the removable base and the reservoir. While the present application describes the bottle as having a circumference for illustration purposes, it should be understood that the bottle can have a shape other than a circular shape, and any discussion of a circumference mentioned herein can also correspond to a width of a shape other than a circular shape.

As described above, the second opening can have a circumference that is smaller than the circumference of the bottle. As a result, interior walls of a reservoir of the bottle can taper toward the second opening to prevent internal lips or ridges within the reservoir. For example, the interior walls of the reservoir can taper gradually beginning at shoulders of the bottle downward toward the second opening. According to another embodiment, the interior walls can taper beginning lower on the reservoir, approximately halfway between the shoulders and the second opening.

According to an exemplary embodiment, the removable base can form a tight fit over the second opening of the bottle. According to an exemplary embodiment, the bottle can include an external ridge or groove associated with the second opening of the bottle. For attachment purposes, the removable base can include a plurality of flexible fingers or prongs that engage the external ridge to couple the removable base with the reservoir. Furthermore, the removable base can comprise a flexible material that can be less rigid than glass or hard plastic. As a result, the removable base can protect the bottle and other bottles that may be contacted when a bartender places the bottle back within a well of a bar. The flexible material can also result in sound deadening when the removable base contacts another bottle in the well.

In some embodiments, the removable base can include an upper lip portion that is configured to contact an underside ledge of the bottle located proximate to the second opening when the removable base is coupled to the bottle. In some embodiments the upper lip portion can be configured to block condensation or other liquid from entering and pooling within a gap formed between the removable base and the bottle when the removable base is coupled to the bottle.

Figure 1B:
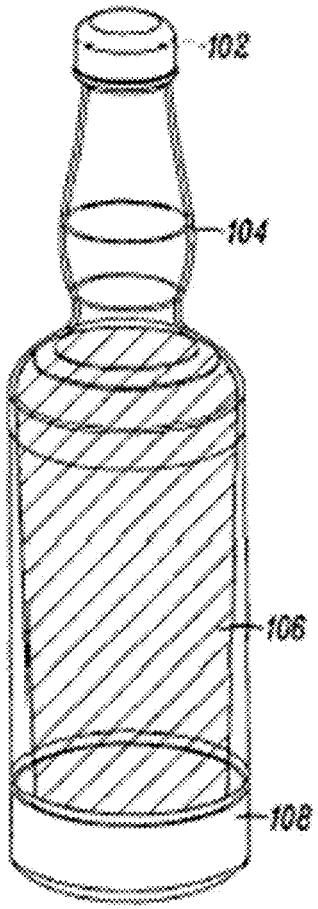

FIGS. 1A and 1B illustrates a bottle 100 according to an exemplary embodiment. As shown in FIG. 1, the bottle 100 can include a cap 102, a bottle neck 104, a reservoir 106, and a removable base 108. As shown, the bottle 100 can be shaped generally like a wine bottle or a beer bottle, in that the reservoir 106 is wider than the neck 104. In some embodiments, the bottle 100 is a reusable wine bottle or a bottle used in the bar and restaurant industry, but the bottle 100 is not so limited. Indeed, the bottle 100 can store any liquid, alcoholic or otherwise. For example, the bottle 100 can store olive oil or syrups. According to an exemplary embodiment, the bottle 100 can store at least 750 mL of liquid, but the bottle 100 can vary in size.

According to an exemplary embodiment, the neck 104 and the reservoir 106 can comprise glass, but the neck 104 and reservoir 106 can also comprise any food-safe polymer (e.g. BPA-free plastics), and preferably any green polymer, such as polypropelene, medical grade silicon, or a polymer based on keratin from chicken feathers. In general, green polymers can comprise a high content of raw material in the polymer, a clean (no-waste) production process, no use of additional substances such as organic solvents, high energy efficiency in manufacturing, and use of renewable resources and renewable energy. In addition, the cap 102 and the base 108 can also comprise a food safe or green polymer. In some embodiments, the cap 102, the neck 104, the reservoir 106, and the base 108 comprise an ABS thermoplastic.

Figure 1C:
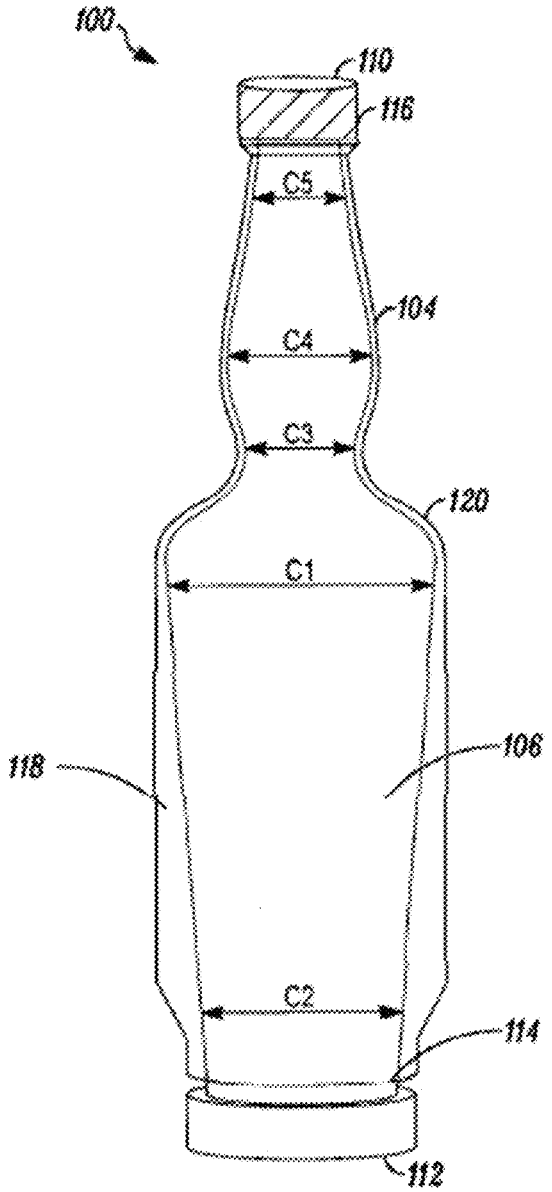

Referring now to FIG. 1C, the bottle 100 includes a first opening 110 and a second opening 112. The first opening 110 can be located proximate to the neck 104, and the second opening 112 can be located proximate to the reservoir 106. Still referring to FIG. 1C, cap threading 116 can be associated with the first opening 202 to receive the cap 102. In some embodiments, the first opening 110 can be sized to accept universally-sized pour spouts. Furthermore, due to the second opening 112 being wider than a conventional bottle opening (e.g. a size of the first opening 110), solids, such as fruit for infusing, can be stored within and easily inserted into the bottle 100.

Furthermore, the bottle 100 can include a ridge 114 configured to receive attachment members of the removable base 108 (described further below). The ridge 114 can be adjacent to the second opening 112, and the ridge 114 can traverse around all of part of the bottle 100.

As shown in FIG. 1C, the bottle 100 can include an internal taper 118 within the reservoir 106 such that a first internal diameter D1 located closer to the first opening 110 is larger than a second internal diameter D2 located closer to the second opening 112. The internal taper 118 creates a smooth surface within the reservoir 106 and prevents a lip forming proximate to the second opening 112. According to an exemplary embodiment, the internal taper 118 can begin at shoulders 120 of the bottle 100 and can continue to the second opening 112. In other words, a thickness of the glass or plastic comprising the bottle 100 increases from the shoulders 120 to the second opening 112.

Furthermore, still referring to FIG. 1C, the neck 104 can have an ergonomic shape so that a user, such as a bartender, can easily and securely grip the bottle 100 by the neck 104. The neck 104 can be ergonomically shaped such that a third internal diameter D3 of the neck 104 located proximate to the shoulders 120 can be less than a fourth internal diameter D4 of the neck 104 located between the shoulders 120 and the first opening 110. Furthermore, the fourth internal diameter D4 can also be larger than a fifth internal diameter D5 of the neck 104 located proximate to the first opening 110. In some embodiments, the third internal diameter D3 and the fifth internal diameter D5 can be substantially similar in width.

Figure 1D:
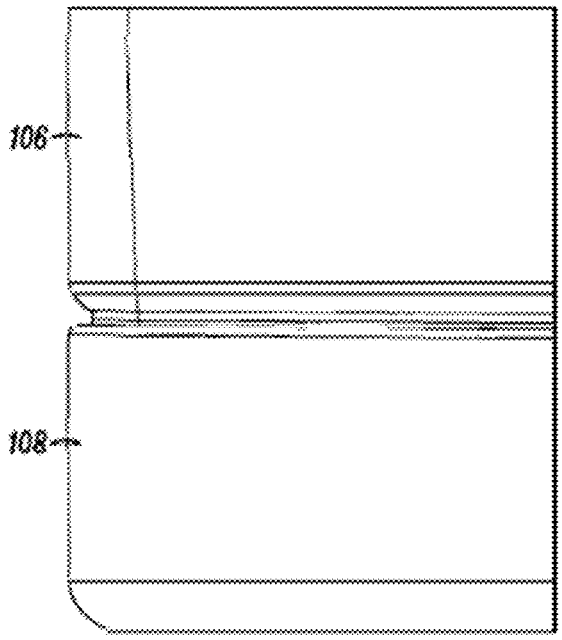

Referring now to FIG. 1D, an extending width or external circumference of the removable base 108 can be substantially equal to an extending width or external circumference of the reservoir 106. By sizing the extending width or external circumference of the removable base 108 and the extending width or external circumference of the reservoir 106 to be substantially equal, the bottle 100 can have a generally flush exterior between the removable base 108, and the bottle 100 can fit within a well of a bar. In addition, providing flush sides of the bottle 100 can decrease the chances that the removable base 108 is removed accidentally, thereby spilling all liquid contained in the reservoir 106.

Figure 1E:
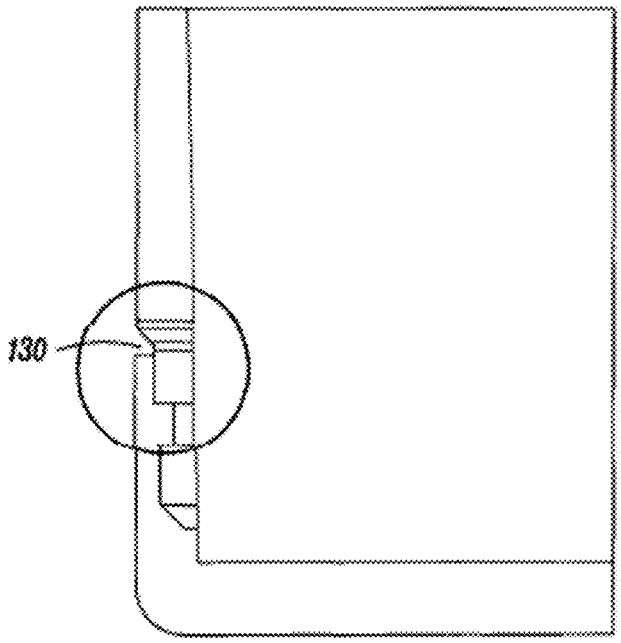
Figure 1F:
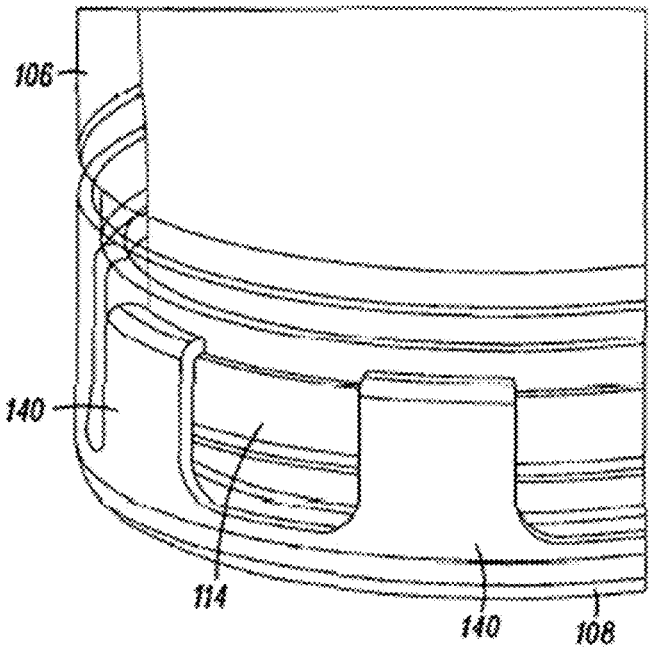

Referring now to FIG. 1E, while the reservoir 106 and the base 108 can have a generally flush exterior, a recess area 130 can be created by molding a bottom portion of the reservoir 106 to decrease in circumference or extending width above the ridge 114 (See FIG. 1C). The recess area 130 can provide a point at which a user can insert a finger or lever to cause the removable base 108 to be removed from engaging the ridge 114.

The removable base 108 can have some flexible aspects causing the removable base 108 to flex and disengage from the ridge 114 when an outward force is applied to the removable base 108. For example, referring to FIG. 1F, a plurality of flexible fingers 140 of the removable base 108 can engage the ridge 114 to couple the removable base 108 to the reservoir 106. The flexible fingers 140 can be overmolded and engage the ridge 114. In an alternative embodiment, the flexible fingers 140 can comprise a single flexible finger traversing around the entire circumference of the removable base 108 (see FIGS. 6A and 6B).

Figure 1G:
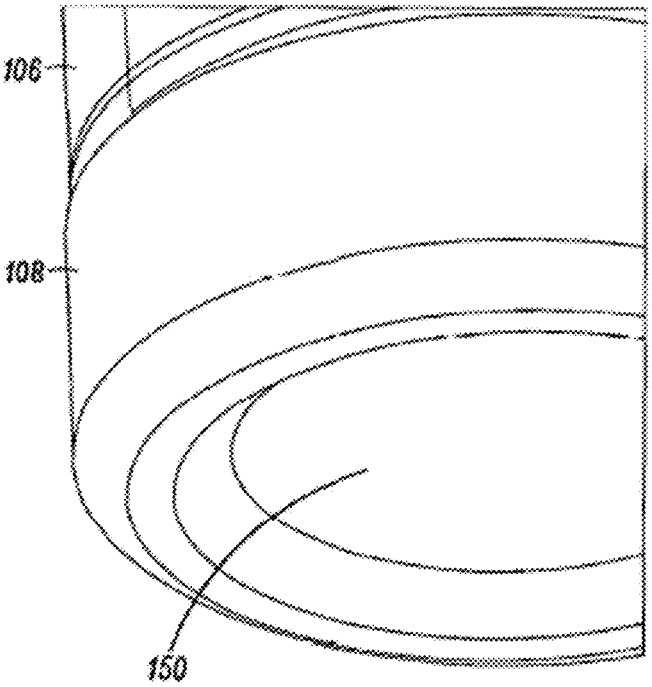

Finally, referring to FIG. 1G, the removable base 108 can include a recessed bottom 150. Furthermore, although not illustrated, the removable base 108 can include a gasket or other structure to prevent leakage of any liquid stored within the reservoir 106.

Figure 2A:
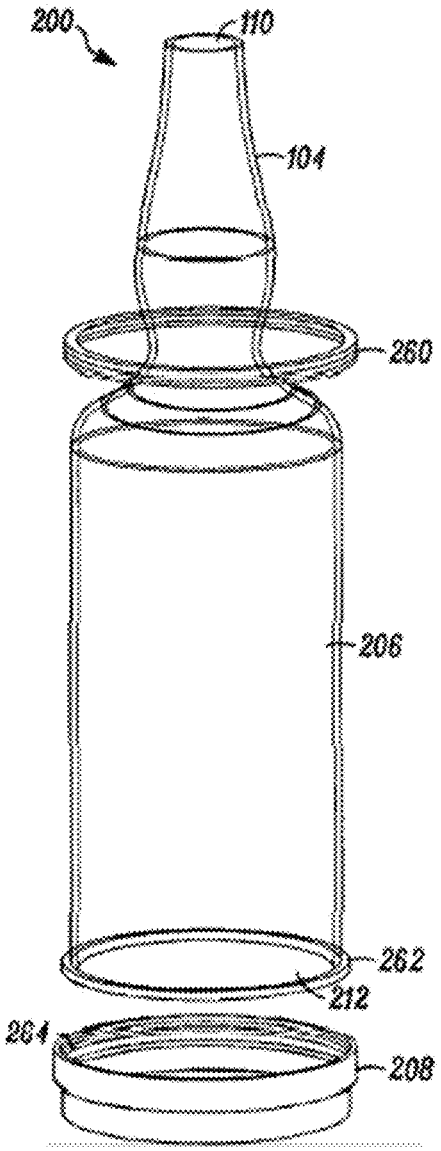
FIGS. 2A-2C are views of a bottle in accordance with a second embodiment.
Figure 2B:
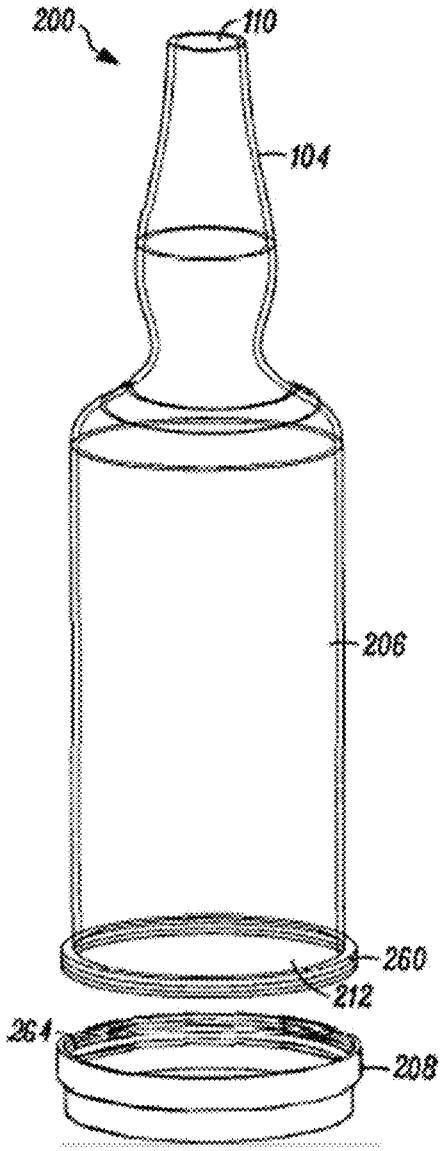
Figure 2C:
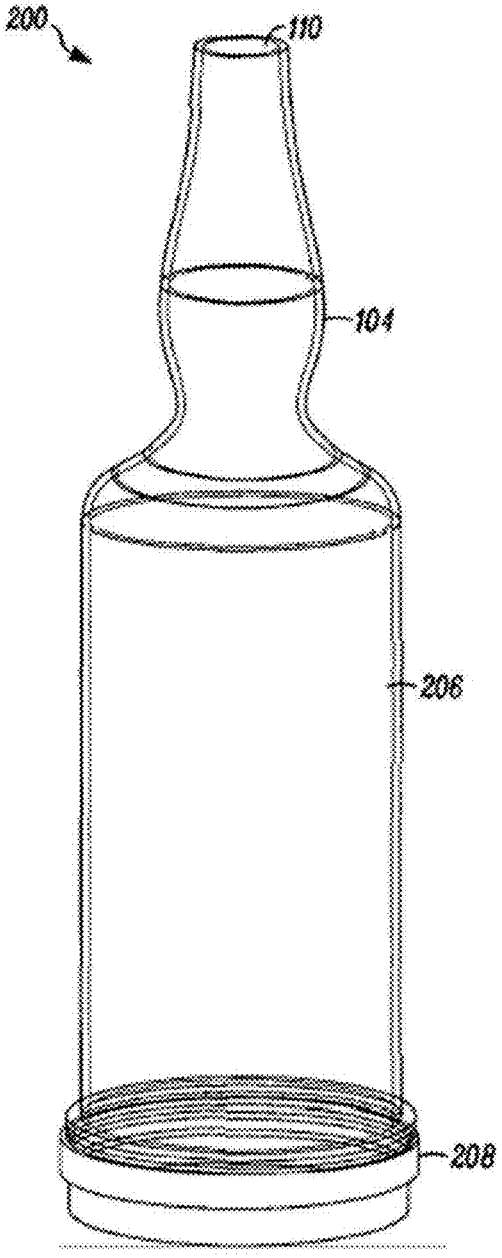

FIGS. 2A-2C illustrate a bottle 200 according to a second exemplary embodiment. As shown in FIG. 2A-2C, the bottle 200 can include a bottle neck 104, a reservoir 206, a removable base 208, a first opening 110, and a second opening 212. According to the second embodiment, the neck 104 and the first opening 110 can be substantially similar to the first embodiment illustrated in FIGS. 1A-1G.

The reservoir 206 can be similar to the reservoir 106, but the reservoir 206 includes a lip 262 to engage a retainer ring 260 for retaining the removable base 208 to the reservoir 206. Furthermore, an internal diameter of the reservoir 206 can be substantially constant throughout the reservoir 206. Furthermore, the second opening 212 can be similar to the second opening 112, however a diameter of the second opening 212 can be substantially equal to the internal diameter of the reservoir 206.

As shown in FIG. 2B, the retainer ring 260 can slide down an external surface of the reservoir 206 until the retaining ring 260 engages the lip 262, which can stop lateral movement of the retaining ring 260 down the bottle 200. Once in place, the retaining ring 260 can be used to engage a corresponding retaining structure 264 on the removable base 208 to couple the removable base 208 to the reservoir 206 (see FIG. 2C). For example, the retaining ring 260 can include male threading, and the retaining structure 264 can comprise female threading, but other complimentary structures can comprise the retaining ring and the retaining structure 264, such as detents and protrusions, friction fit structures, snap fit structures, or temporary adhesive.

Figure 3C:
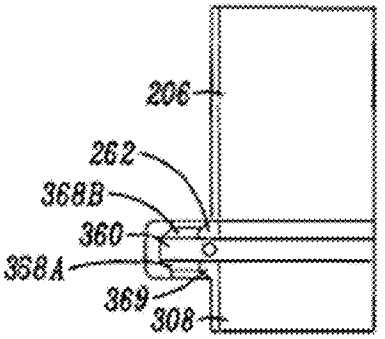
FIGS. 3A-3C are views of a bottle in accordance with a third embodiment.
Figure 3B:
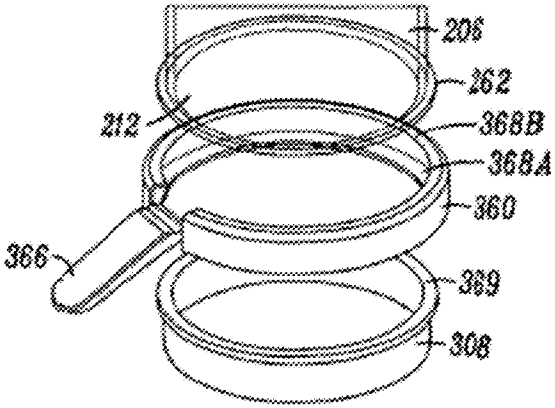
Figure 3A:
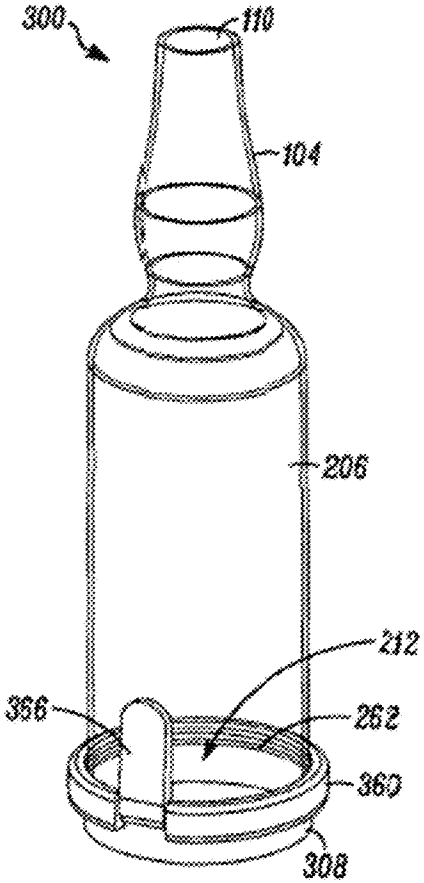

FIGS. 3A-3C illustrate a bottle 300 according to a third exemplary embodiment. As shown in FIG. 3A-3C, the bottle 300 can include a bottle neck 104, a reservoir 206, a removable base 308, a first opening 110, and a second opening 212. According to the third embodiment, the neck 104 and the first opening 110 can be substantially similar to the first embodiment illustrated in FIGS. 1A-1G, and the reservoir 206 and the second opening 212 can be substantially similar to the second embodiment illustrated in FIGS. 2A-2C. Indeed, the reservoir 206 of the bottle 300 can also include a lip 262 similar to the second embodiment illustrated in FIGS. 2A-2C.

Furthermore, the bottle 300 can include a retaining ring 360 that comprises a cam lever 366. The retaining ring 360 can expand and retract based on a position of the cam level 366. For example, when the cam lever 366 is substantially parallel with a main axis of the bottle 300, the retaining ring 360 can have a smaller circumference than when the cam lever 360 is substantially perpendicular to the main axis of the bottle 300. That is, rotating the cam level 366 can retract the retaining ring 360 so that the retaining ring 360 couples and tightly engages the lip 262 and the removable base 308.

As best shown in FIG. 3C, the retaining ring 360 can include two ridges 368A and 368B respectively positioned on opposite ends of the retaining ring 360. In addition, the removable base 308 can include a base lip 369. When positioned and aligned, the retaining ring 360 can couple the removable base 308 to the reservoir 306. The retaining ring 360 can couple the removable base 308 and the reservoir 306 by having the first ridge 368A engage the lip 262 and the second ridge 368B engage the base lip 369. The first and second ridges 368A, 368B can be ramped at an angle corresponding to the lip 262 and the base lip 369.

FIGS. 4A-4D illustrate a bottle 400 according to a fourth exemplary embodiment. As shown in FIG. 4A-4D, the bottle 400 can include a bottle neck 104, a reservoir 206, a removable base 408, a first opening 110 and a second opening 212. According to the fourth embodiment, the neck 104 and the first opening 110 can be substantially similar to the first embodiment illustrated in FIGS. 1A-1G, and the reservoir 206, the second opening 212, and the lip 262 can be substantially similar to the second embodiment illustrated in FIGS. 2A-2C.

Furthermore, the bottle 400 can include a tree spring 472, a threaded rod 470, and a wing nut 474. As would be known to one skilled in the art, the tree spring 472 can be a structure that can grasp a flange 478 included in the removable base 408 to couple the removable base 408 to the reservoir 206. According to an exemplary embodiment, the tree spring 472 can be barbed such that barbed legs of the tree spring 472 expand as pressure is applied.

Figure 4A:
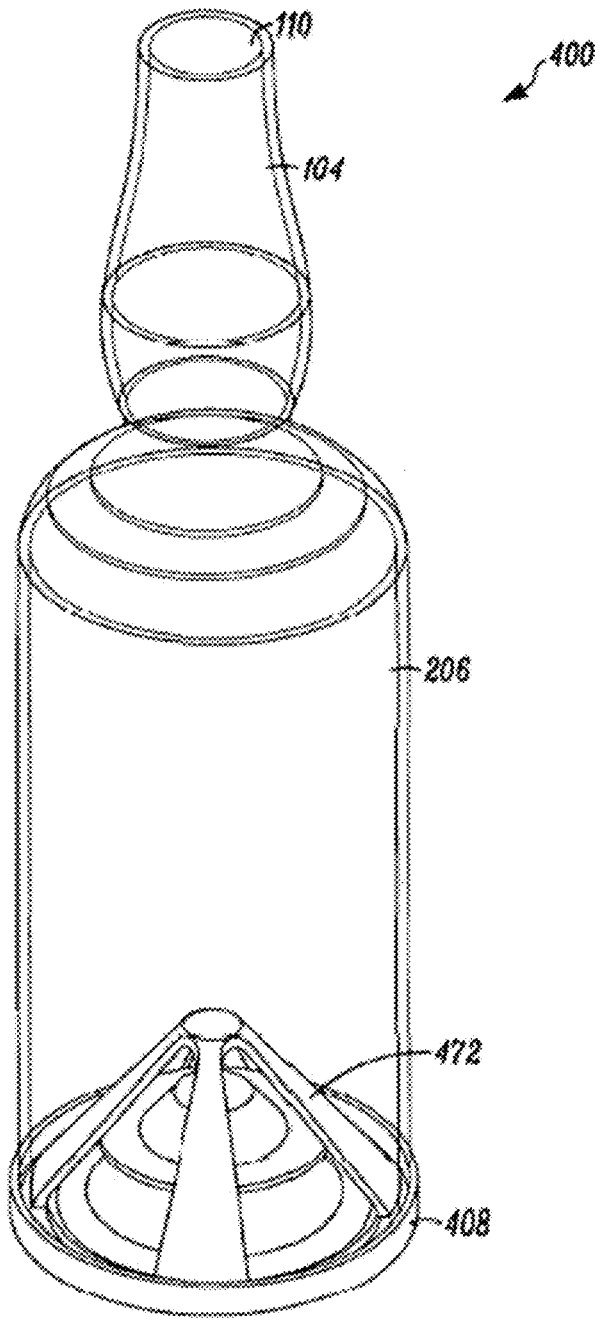
FIGS. 4A-4D are views of a bottle in accordance with a fourth embodiment.
Figure 4B:
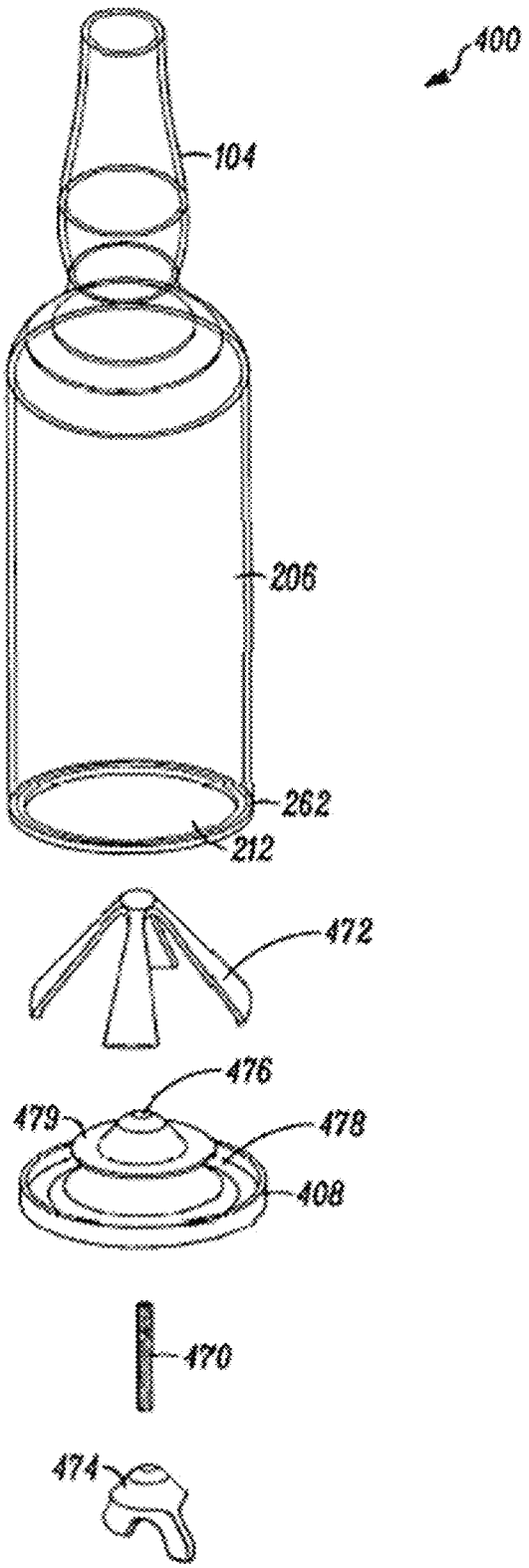
Figure 4C:
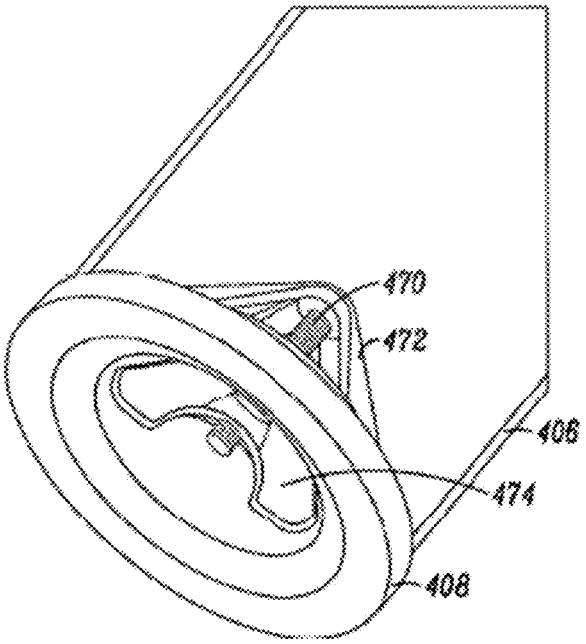
Figure 4D:
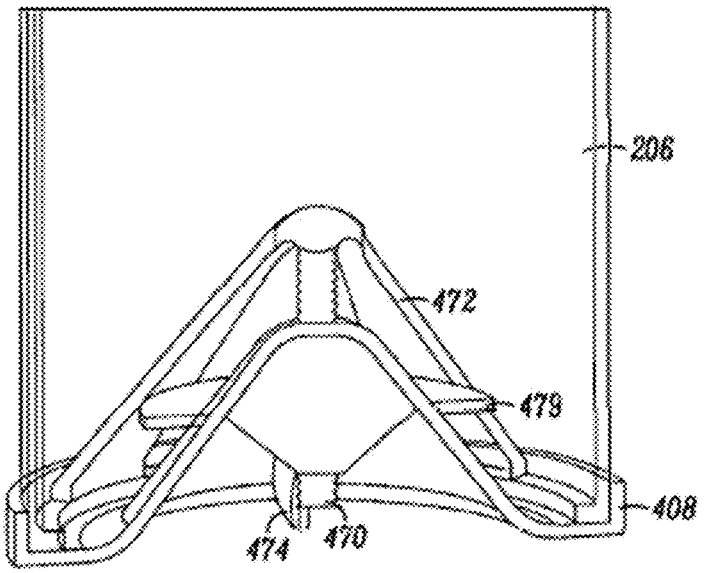

As best shown in FIGS. 4A and 4C, the removable base 408 can be wider (i.e. having a wider circumference) than the reservoir 106. The tree spring 472 can receive a first end of a threaded rod 470 at a base of the tree spring 472, and the threaded rod 470 can extend through a hole 476 in the removable base 408. Furthermore, a second end of the threaded rod 470 can receive a wing nut 474.

As the wing nut 474 is turned on the threaded rod 470, the wing nut 474 applies an upward force to a bottom surface of the removable base 408, which in turn applies an upward force to the lip 262 at the bottom of the reservoir 206, thereby sealing the bottle 400. To secure a connection between the removable base 408 and the reservoir 206, a lip 479 of the removable base 408 can engage the legs of the tree spring 472 as the wing nut 474 applies upward force, thereby spreading the legs of the tree spring 472 within the flange 478 and against interior sides of the reservoir 206.

FIGS. 5A-5F illustrate a bottle 500 according to a fifth exemplary embodiment. As shown in FIG. 5A-5F, the bottle 500 can include a cap 102, cap threading 116, a bottle neck 104, a reservoir 506, a removable base 508, a first opening 110 and a second opening 112. According to the fifth embodiment, the cap 102, the cap threading 116, the neck 104, the first opening 110, and the second opening 112 can be substantially similar to the first embodiment illustrated in FIGS. 1A-1G.

Figure 5A:
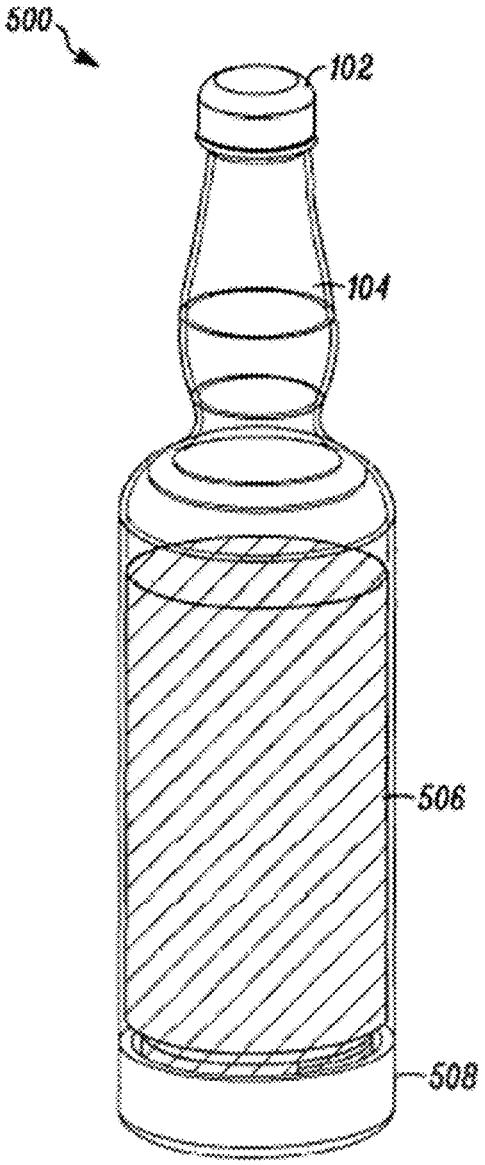
FIGS. 5A-5F are views of a bottle in accordance with a fifth embodiment.
Figure 5B:
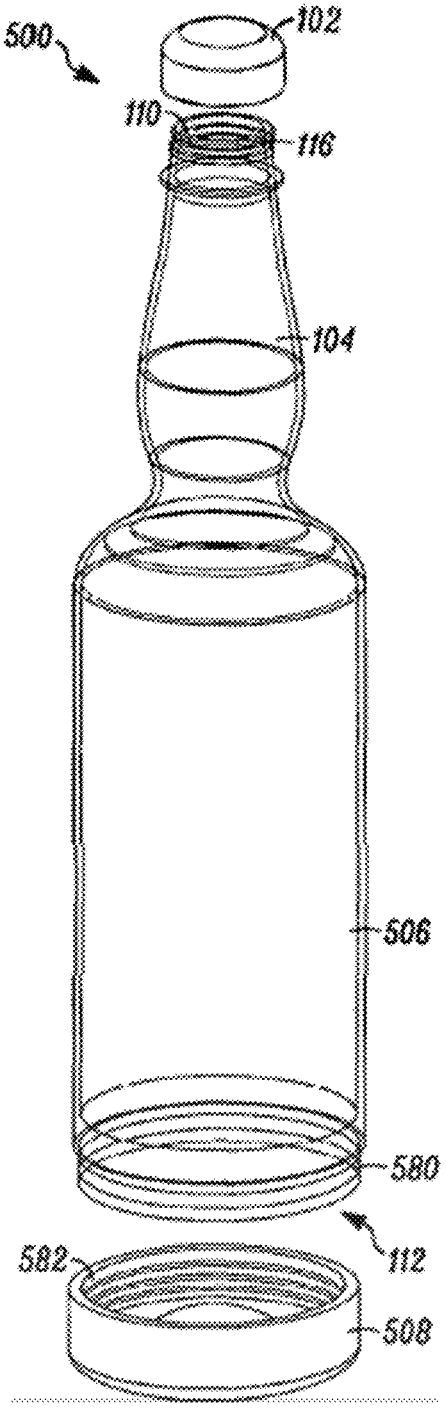
Figure 5C:
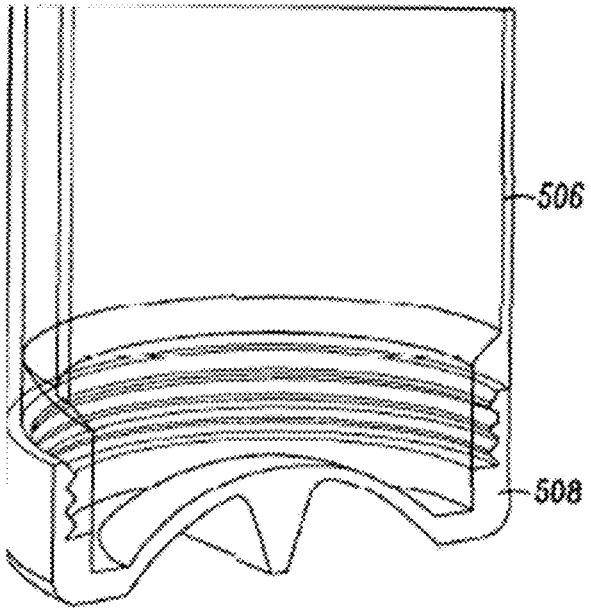

The reservoir 506 can be similar to the reservoir 106, but the reservoir 506 includes threading 580 for retaining the removable base 508 to the reservoir 506. As shown in FIG. 5B, the removable base 508 can also include base threading 582. The threading 580 and the base threading 582 can be complimentary such that the removable base 508 is received by the threading 580, and the removable base 508 screws onto the reservoir 506. For example, the threading 580 can comprise male threading, and the base threading 582 can comprise female threading, or vice versa.

Figure 5D:
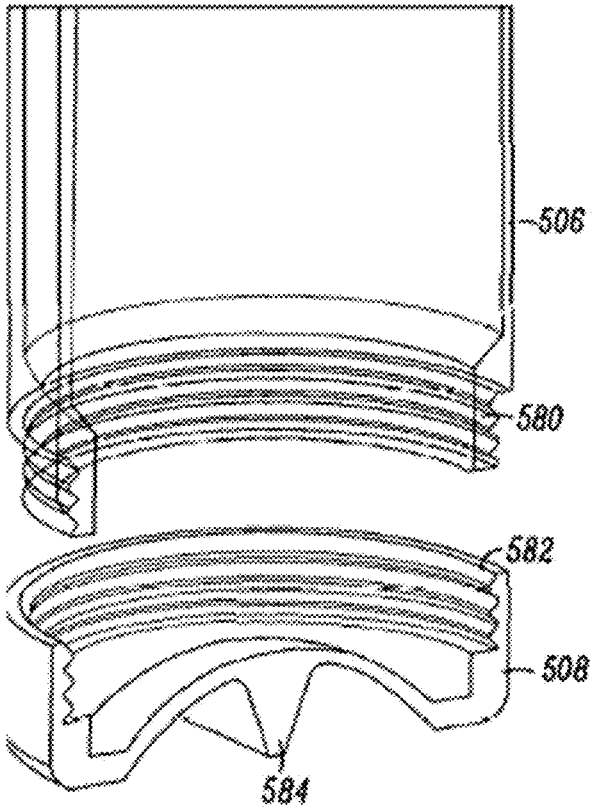
Figure 5E:
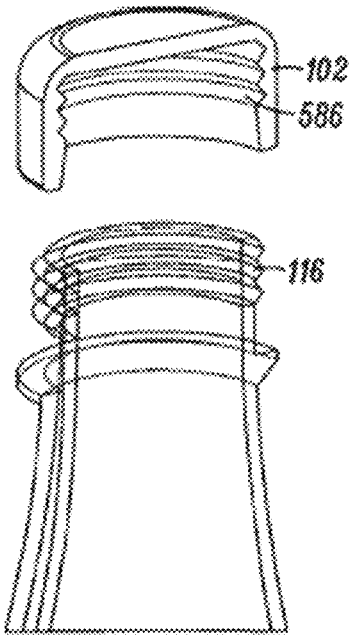
Figure 5F:
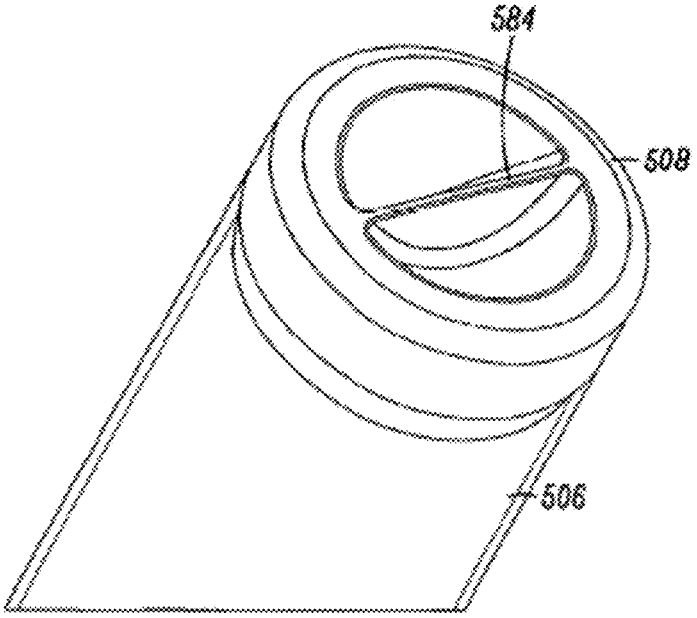

Referring now to FIGS. 5D and 5F, the removable base 508 can comprise a finger grab 584 and a plurality of recesses adjacent to the finger grab 584. A user can use the finger grab 584 to tighten or loosen the removable base 508. Furthermore, FIG. 5E illustrates that the cap 102 can engage the threading 116 with corresponding internal cap threading 586. The cap threading 116 and the internal cap threading 586 can be complimentary such that the cap 102 is received by the cap threading 116, and the cap 102 screws onto the neck 104. For example, the cap threading 116 can comprise male threading, and the internal cap threading 586 can comprise female threading, or vice versa.

Figure 6C:
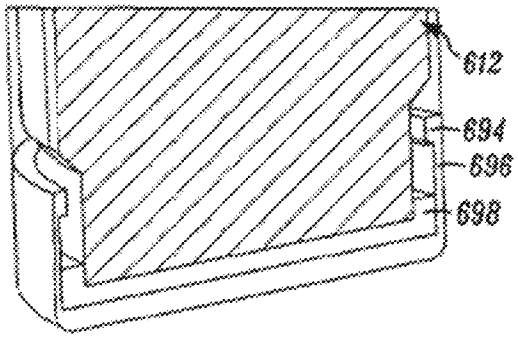
FIGS. 6A-6C are views of a bottle in accordance with a sixth embodiment.
Figure 6B:
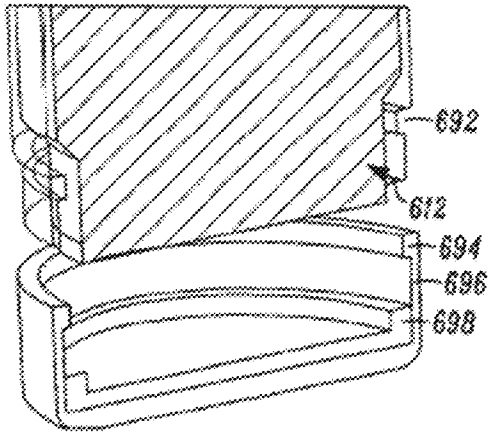
Figure 6A:
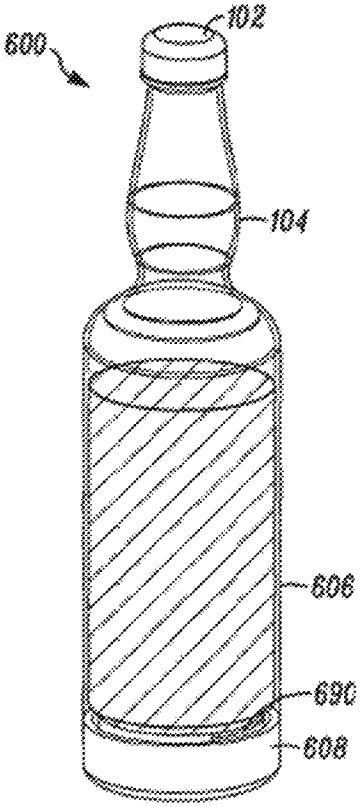
Figure 7A:
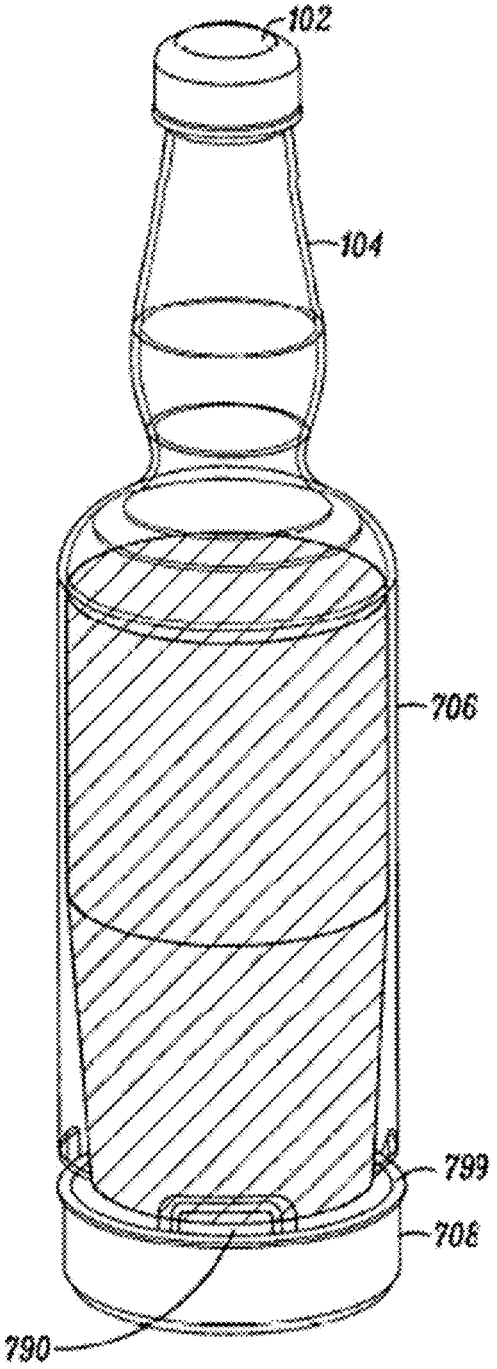
FIGS. 7A-7D are views of a bottle in accordance with a seventh embodiment.
Figure 7B:
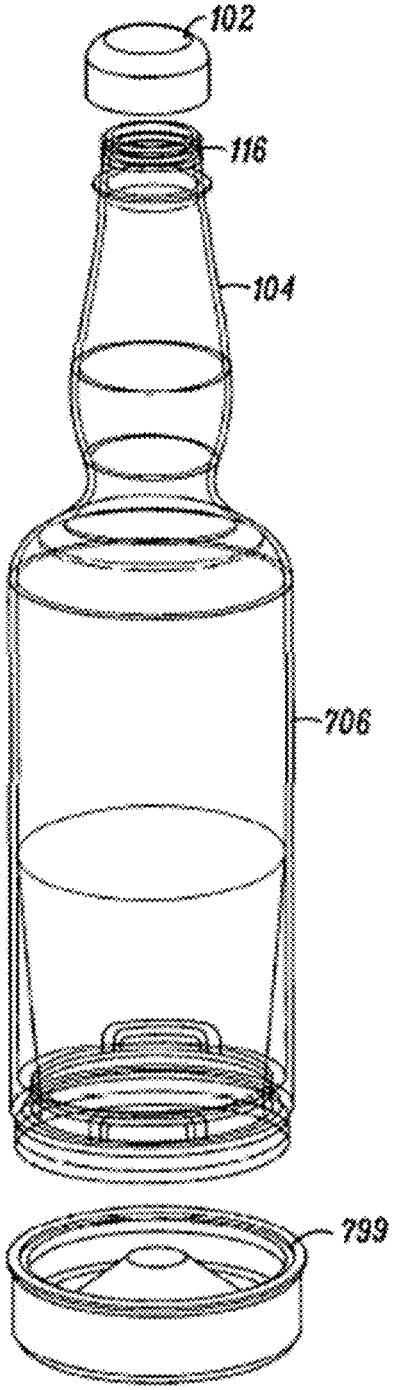
Figure 7C:
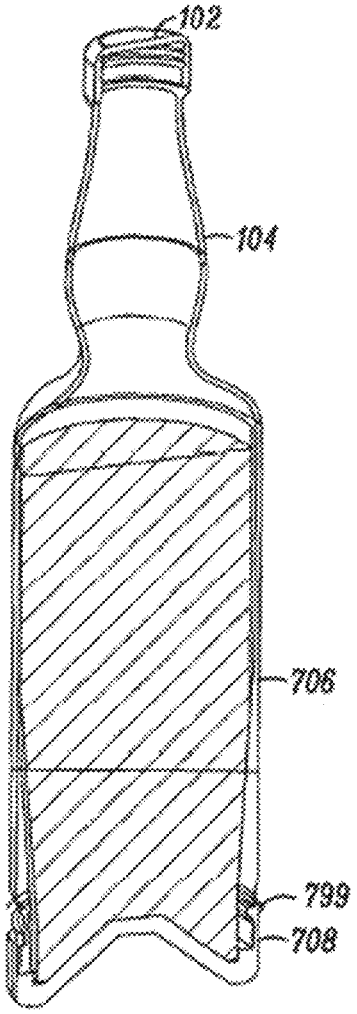
Figure 7D:
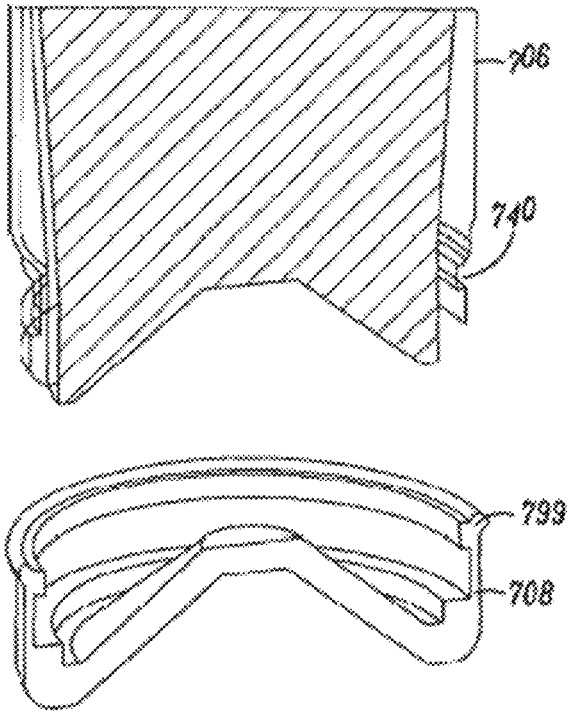

FIGS. 6A-6C illustrate a bottle 600 according to a sixth exemplary embodiment. As shown in FIG. 6A-6C, the bottle 600 can include a cap 102, a bottle neck 104, a reservoir 606, a removable base 608, a second opening 612, and finger relief 690. According to the sixth embodiment, the cap 102 and the neck 104 can be substantially similar to the first embodiment illustrated in FIGS. 1A-1G. Furthermore, although not illustrated, the bottle 600 includes a first opening similar to the first opening 112 illustrated in FIGS. 1A-1G.

Near the second opening 612, the reservoir 606 can include a groove 692 that can receive a flexible lip 694 of the removable base 608. According to an exemplary embodiment, the flexible lip 692 can comprise flexible thermoplastic rubber that can stretch over the second opening 612 to fit within and engage the groove 692, thereby securing the removable base 608 to the reservoir 606. Furthermore, the removable base 608 can be removed when a user places a finger or lever within the finger relief 690 to pull and peel the removable base 608 away from the reservoir 606.

According to an exemplary embodiment, the removable base 608 can comprise a flexible portion 694 comprising the thermoplastic rubber and a rigid portion 692 comprising a rigid plastic.

FIGS. 7A-7D illustrate a bottle 700 similar to the bottle 600 illustrated in FIGS. 6A-6C. However, the bottle 700 includes a plurality of finger reliefs 790 and a protruding lip 799. Furthermore, the bottle 700 can include tapered walls, wherein the taper beings at a point lower than shoulders and within the reservoir. For example, the taper can begin half way between the second opening 712 and the shoulders 120.

Figure 8:
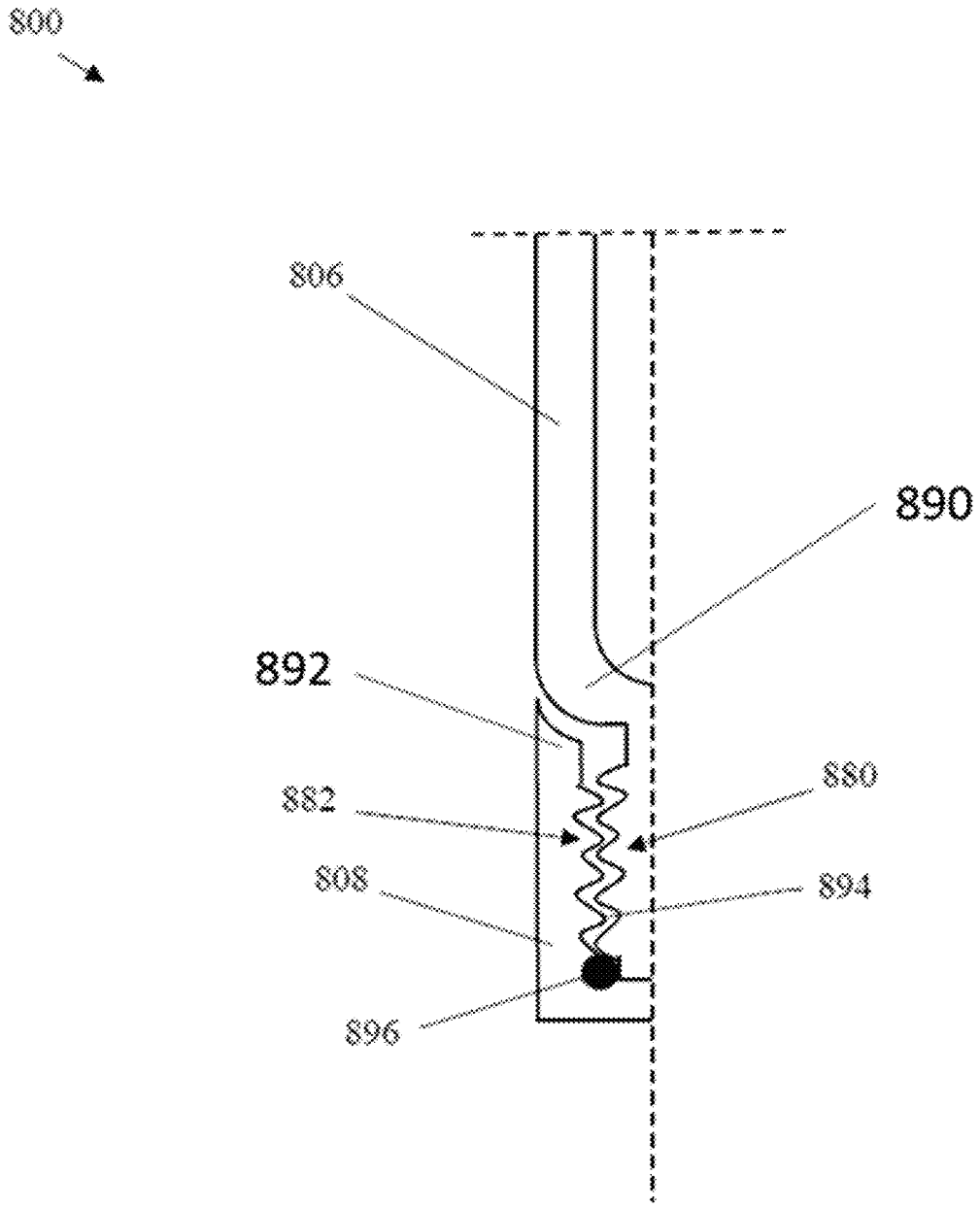
FIG. 8 is a cross-sectional view of a portion of a bottle in accordance with disclosed embodiments.

FIG. 8 illustrates a partial cross-section of a bottle 800 similar to bottles 100-700 described above. As seen in FIG. 8, the bottle 800 can include a reservoir 806 and a removable base 808. Additionally, the bottle 800 can include the first and second openings similar to the first and second 110 and 112 described above. As seen in FIG. 8, the reservoir 806 can include threading 880 for retaining and coupling the removable base 808 to the bottle 800 and an underside ledge 890 that is proximate to the second opening in the bottle 800. According to an exemplary embodiment, the underside ledge 890 curves as the bottle tapers inward toward the second opening. The removable base 808 can include base threading 882 and an upper lip portion 892. The threading 880 and the base threading 882 can be complimentary such that the removable base 808 is received by the threading 880, and the removable base 808 screws onto the reservoir 806. Furthermore, the upper lip portion 892 can have a curvature similar in shape to the curvature of the underside ledge. As such, the curvature of the upper lip portion 892 of the removable base 808 substantially corresponds to the curvature of the underside ledge 890 of the bottle 800. Said differently, the curvature of the underside ledge may be convex, and the curvature of the upper lip portion may be concave, and the amount of curvature of the concave and convex portions may be substantially similar or corresponding in curvature. By shaping the upper lip portion 892 in this manner, the upper lip portion 890 and the underside ledge 890 work together to prevent condensation or other liquid present on the outside of the bottle 800 from entering into and pooling within a cap 894 formed between the removable base 808 and the reservoir 806. Pooled water in this manner may escape when the bottle 800 is flipped upside down and give the impression of leakage from the bottle. Finally, in some embodiments, the bottle 800 can include a silicon or similar material gasket 896 configured to seal the removable base 808 to the reservoir 806 when the threading 880 and the base threading 882 are engaged together.

Figure 9:
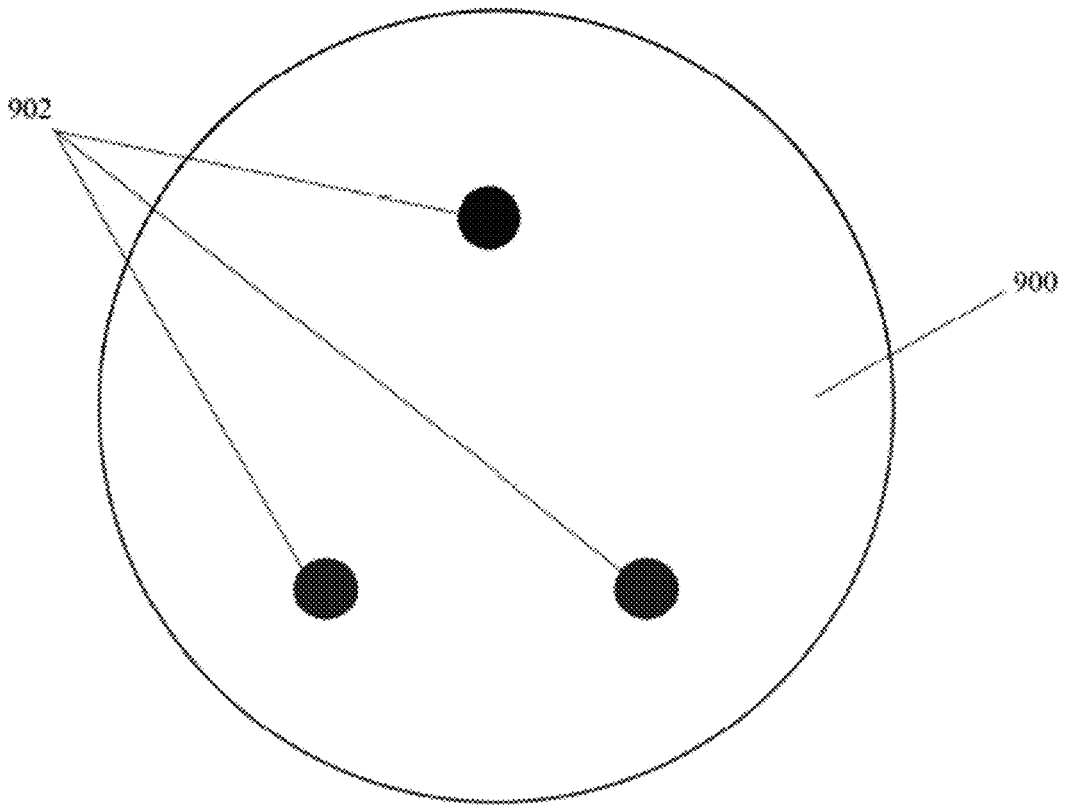
FIG. 9 is a view of a bottom of a bottle in accordance with disclosed embodiments.

FIG. 9 illustrates a bottom of a removable base 900 for use in any of the bottles 100-800 described above. As seen in FIG. 9, the bottom of the removable base 900 can include a plurality of feet 902. The plurality of feet can be integral with the removable cap 900 and can be configured to lift the removable base 900 and any bottle to which it is connected slightly off of a surface and prevent the removable base 900 and bottle from sliding around on the surface or spinning.

Any of the bottles 100-800 solve the problems of conventional bottles because the bottles 100-800 are much easier to clean through the larger opening at the bottom of the bottle 100-800. For example, the bottle can be placed in a dishwasher for quick cleaning and reuse. In addition, because the removable base generates lesser impacts between the bottle 100-700 and other bottles in the bar well, less thick glass walls can be used to create the bottles 100-800.

Although a few embodiments have been described in detail above, other modifications are possible. For example, the steps described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A bottle comprising:

a reservoir formed by one or more walls, the one or more walls having a first circumference;

a first opening on a first end of the bottle providing access to the reservoir;

a second opening on a second end of the bottle providing access to the reservoir;

a first threading formed at or proximate to the second opening;

a cork configured to cover the first opening;

a removable base covering the second opening, the removable base having a second threading configured to engage with the first threading, the second threading being complementary with the first threading; and an underside ledge formed proximate to the second opening and beneath the one or more walls and having a first profile that tapers inward toward the second opening, wherein the removable base includes a gasket configured to seal the removable base to the reservoir when the first threading and the second threading are engaged together, wherein an outer circumference of the removable base is substantially equal to the first circumference of the one or more walls to generate a flush appearance between the removable base and the one or more walls, wherein the removable base further comprises an upper lip, wherein the upper lip tapers such that the upper lip has a second profile that substantially matches the first profile of the underside ledge and the upper lip formed at the outer circumference is formed higher and closer to the first opening than the upper lip formed at an inner circumference of the upper lip, wherein the second threading is formed under the upper lip, and wherein the first profile of the underside ledge is a convex profile.

2. The bottle of claim 1 further comprising an ergonomic bottleneck.

3. The bottle of claim 1 wherein the removable base includes a recessed bottom.

4. The bottle of claim 1 wherein the bottle stores at least 750 mL of liquid.

5. The bottle of claim 1 wherein the second profile of the upper lip is a concave profile.

6. The bottle of claim 1 wherein the removable base further comprises a plurality of feet formed on the underside of the removable base configured to lift a bottom surface of the removable base and the reservoir above a surface on which the bottle is placed.

7. The bottle of claim 6 wherein the removable base comprises three feet.

8. A bottle comprising:

a reservoir formed by one or more walls, the one or more walls having a first circumference;

a first opening on a first end of the bottle providing access to the reservoir;

a second opening on a second end of the bottle providing access to the reservoir;

a first threading formed at or proximate to the second opening;

a cork configured to cover the first opening;

a removable base covering the second opening, the removable base having a second threading configured to engage with the first threading, the second threading being complementary with the first threading; and an underside ledge formed proximate to the second opening and beneath the one or more walls and having a first profile that tapers inward toward the second opening, wherein the removable base includes a gasket configured to seal the removable base to the reservoir when the first threading and the second threading are engaged together, wherein an outer circumference of the removable base is substantially equal to the first circumference of the one or more walls to generate a flush appearance between the removable base and the one or more walls, wherein the removable base further comprises a structure formed on the underside of the removable base configured to prevent the removable base from sliding on a surface, wherein the removable base further comprises an upper lip, wherein the upper lip tapers such that the upper lip has a second profile that substantially matches the first profile of the underside ledge and the upper lip formed at the outer circumference is formed higher and closer to the first opening than the upper lip formed at an inner circumference of the upper lip, wherein the second threading is formed under the upper lip, and wherein the first profile of the underside ledge is a convex profile.

9. The bottle of claim 8 further comprising an ergonomic bottleneck.

10. The bottle of claim 8 wherein the removable base includes a recessed bottom.

11. The bottle of claim 8 wherein the bottle stores at least 750 mL of liquid.

12. The bottle of claim 8 wherein the second profile of the upper lip is a concave profile.

13. The bottle of claim 8 wherein the removable base comprises three feet.

14. A bottle comprising:

a reservoir formed by one or more walls, the one or more walls having a first circumference;

a first opening on a first end of the bottle providing access to the reservoir;

a second opening on a second end of the bottle providing access to the reservoir;

a first threading formed at or proximate to the second opening;

a removable base covering the second opening, the removable base having a second threading configured to engage with the first threading, the second threading being complementary with the first threading; and an underside ledge formed proximate to the second opening and beneath the one or more walls and having a first profile that tapers inward toward the second opening, wherein the removable base includes a gasket configured to seal the removable base to the reservoir when the first threading and the second threading are engaged together, wherein an outer circumference of the removable base is substantially equal to the first circumference of the one or more walls to generate a flush appearance between the removable base and the one or more walls, wherein the removable base further comprises a structure formed on the underside of the removable base configured to prevent the removable base from sliding on a surface, wherein the removable base further comprises an upper lip, wherein the upper lip tapers such that the upper lip has a second profile that substantially matches the first profile of the underside ledge and the upper lip formed at the outer circumference is formed higher and closer to the first opening than the upper lip formed at an inner circumference of the upper lip, wherein the second threading is formed under the upper lip, and wherein the first profile of the underside ledge is a convex profile.

* * * * *